US006551012B1

(12) United States Patent
Hoebergen et al.

(10) Patent No.: US 6,551,012 B1
(45) Date of Patent: Apr. 22, 2003

(54) GUARD RAIL CONSTRUCTION

(75) Inventors: Laurentius Maria J. A. Hoebergen, Den Hoorn (NL); Frederik Johan Wiltink, Haarlem (NL)

(73) Assignee: Nederladnse Organisatie voor Toegepast-Natuurwetenschappelijk on-Derzoek Tno, Delft (NL)

( * ) Notice: Subject to any disclaimer, the term of this patent is extended or adjusted under 35 U.S.C. 154(b) by 0 days.

(21) Appl. No.: 09/857,753

(22) PCT Filed: Dec. 9, 1999

(86) PCT No.: PCT/NL99/00754

§ 371 (c)(1),
(2), (4) Date: Jul. 24, 2001

(87) PCT Pub. No.: WO00/34585

PCT Pub. Date: Jun. 15, 2000

(30) Foreign Application Priority Data

Dec. 10, 1998 (NL) ..... 1010776

(51) Int. Cl.[7] ..... E01F 15/00
(52) U.S. Cl. ..... 404/6; 404/10; 256/13.1
(58) Field of Search ..... 404/6, 9, 10; 256/13.1

(56) References Cited

U.S. PATENT DOCUMENTS

| | | | | | |
|---|---|---|---|---|---|
| 2,093,577 | A | * | 9/1937 | Shepherd | 256/13.1 |
| 3,077,339 | A | * | 2/1963 | White | 256/13.1 |
| 3,332,666 | A | * | 7/1967 | Gray | 256/13.1 |
| 3,417,965 | A | | 12/1968 | Gray et al. | |
| 3,589,681 | A | * | 6/1971 | Ackerman | 256/13.1 |
| 3,638,913 | A | * | 2/1972 | Persicke | 256/13.1 |
| 3,981,486 | A | * | 9/1976 | Baumann | 256/1 |
| 4,739,971 | A | * | 4/1988 | Ruane | 256/13.1 |
| 4,923,327 | A | * | 5/1990 | Gorlov | 404/6 |
| 5,044,609 | A | * | 9/1991 | Cicinnati et al. | 256/13.1 |
| 5,219,241 | A | | 6/1993 | Picton | |
| 5,348,416 | A | * | 9/1994 | Ivey et al. | 256/13.1 |
| 5,660,375 | A | | 8/1997 | Freeman | |
| 5,921,702 | A | * | 7/1999 | Fitch | 256/13.1 |
| 6,398,192 | B1 | * | 6/2002 | Albritton | 256/1 |

FOREIGN PATENT DOCUMENTS

| | | |
|---|---|---|
| CH | 435 357 | 5/1967 |
| CH | 511 336 | 8/1971 |
| DE | 1 143 843 | 2/1963 |
| DE | 1 295 581 | 5/1969 |
| EP | 0 519 851 | 12/1992 |
| EP | 0 677 615 | * 10/1995 |
| FR | 2 169 997 | 9/1973 |
| NL | 6601985 | 10/1966 |

* cited by examiner

*Primary Examiner*—Gary S. Hartmann
(74) *Attorney, Agent, or Firm*—Leydig, Voit & Mayer, Ltd.

(57) ABSTRACT

A guard rail construction comprises support elements to be provided at a side of a road and a guard member attached hereto, wherein, when a vehicle touches the guard member in and adjacent the collision point thereof, one or more support elements can pivot in rearward direction relative to the road about a pivot point and can absorb at least a part of the collision energy. The guard rail construction can pivot in rearward direction to such an extent that it can be supported on the ground by a support point. The angle ϕ between the line through the pivot point and the collision point and the line through the pivot point and the support point is greater than 90°.

14 Claims, 3 Drawing Sheets

GUARD RAIL CONSTRUCTION

FIELD OF THE INVENTION

The present invention relates to a guard rail construction, comprising support elements to be provided at a side of a road and a guard member attached hereto, wherein, when a vehicle couches the guard member in and adjacent the collision point thereof, one or more support elements can pivot in rearward direction relative to the road about a pivot point and can absorb at least a part of the collision energy, while the guard rail construction can pivot in rearward direction to such an extent that it can be supported on the ground by a support point.

BACKGROUND OF THE INVENTION

Such guard rail constructions are known and have presently been installed alongside many Dutch roads. In these constructions, guard members in the form of guard rails have been provided symmetrically on either side of the support element. The center of the guard member against which a collision takes place will hereinafter be referred to as the collision point. When a vehicle contacts a guard rail, the support element will make a rearward tilting movement. The point about which the support element moves rearwards will hereinafter be referred to as the pivot point. On bridges, this pivot point is at the ground level, by means of a break connection. In the guard rail constructions mentioned, the height of the center of the guard rails, i.e. the distance at which the collision point lies above the ground level, is about 60 cm. The overall height of the system, i.e. the distance from the top side of the guard rail to the ground level, is about 75 cm. The system is further determined by, inter alia, the angle $\alpha$ made by the line between the pivot point and the collision point with the ground level. When the pivot point lies approximately at ground level, a situation which, as mentioned hereinabove, may occur when the guard rail construction is installed on, for instance, bridges, this angle $\alpha$ will be about 56°. When in this situation the guard rail construction during a collision moves rearwards about the pivot point, the height thereof increases at first by about 11%, to subsequently decrease until eventually approximately the same level is reached which the guard rail construction had before the collision. The guard rail mounted on the side of the support element other than the side of the guard rail against which the vehicle has collided, will then in many cases, after tilting of the support element through an angle $\beta$ of about 52°, be supported on the ground. The point of the guard rail construction by which it can be supported on the ground after a collision will hereinafter be referred to as the support point. The angle $\phi$ between the line through the pivot point and the collision point and the line through the pivot point and the support point will, in the case where the pivot point is at the ground level, be about 76°.

In the guard rail construction here mentioned, the vehicle may, during a collision, contact the support element. In particular for heavier vehicles, where the point of gravity lies above the level of the guard rail construction, this will involve the serious risk that, due to the rolling behavior about the longitudinal axis of the vehicle occurring during the collision against the guard rail construction, the vehicle actually rolls over the guard rail construction.

A contact of the vehicle with the support element can be prevented by providing that the pivot point comes to lie below the ground level, which, in practice, is in fact realized along roads over the ground. In that case, the pivot point lies about 60 cm below the ground level. The angle $\alpha$ then approximately assumes the value of 72°. When, during a collision, the guard rail construction moves rearwards, with the support element moving for a substantial part through the ground, a slight height increase of about 5% occurs at first, whereupon the height of the system decreases to below the original value by about 7%. Further, due to the larger distance between the pivot point and the guard rails, a greater rearward travel is made by the guard rail construction and, accordingly, the space required for the proper functioning increases considerably. When the rearmost guard member finds support on the ground, the support element will approximately have pivoted through an angle $\beta$ of about 40°, which value is considerably less than in the case where the pivot point lies at the ground level. It is true that by positioning the pivot point below the ground level, the chance of a colliding vehicle touching the support element decreases, but the danger of tilting of the vehicle is not reduced at all.

SUMMARY OF THE INVENTION

The object of the invention is to avoid the above-mentioned drawbacks, or at least to reduce them to a considerable extent, and to provide a guard rail construction wherein the chance that vehicles, during a collision, can roll over the guard rail construction is reduced substantially, without the guard rail construction in its fixed arrangement being in a higher position and thereby hindering or even blocking the view of the lateral side of the road and without affecting the beauty of the landscape too much.

To realize this object, the guard rail construction as described in the preamble is characterized in that the angle $\phi$ between the line through the pivot point and the collision point and the line through the pivot point and the support point is greater than 90°.

Due to this feature, it is achieved that a vehicle colliding against the guard rail construction will not contact the support element. Further, during a rearward pivoting movement of the guard member that is contacted by the vehicle, the height,of this guard member can only increase. As or just before the moment when the guard member reaches its highest point, the guard rail construction will be supported on the ground. Through a suitable dimensioning, this height increase during a collision may run up to as much as 25% and more. Due to this rising movement of the guard member, a couple is exerted on the colliding vehicle, which couple opposes the couple which, during the collision, is exerted on the vehicle by the guard member and causes the vehicle to tilt in the direction of the guard rail construction. The effect further achieved is that for performing a rearward pivoting movement, relatively little extra space is needed.

Although a guard member may be present on both sides of the support element, in the guard rail construction according to the invention it is sufficient when such guard member is present only on the road-facing side of the support element.

To effect a substantial height increase during the rearward pivoting movement of the guard rail construction, the pivot point preferably lies at or relatively close below the ground level.

For stability reasons, it is preferred that the angle $\beta$ through which the support element can pivot before the support point comes to lie on the ground, be less than 45°. For the same reason, it may be favorable when the support point is located at a lower position than the bottom side of the guard member. However, it is possible to lower the bottom side of the guard member or, stated differently, to extend the guard member downwards, for instance for retaining motorcyclists who come to fall; in that case, the support point may come to lie above the bottom side of the guard member all the same.

Although it is possible that the collision energy that is absorbed at first is entirely taken up in the pivot point, for instance by designing this pivot point as a deformable pivot, it is preferred that a deformable element be mounted on the support element between the support point and the ground on which the support element can be supported. This element can then absorb a substantial part of the collision energy. When his element has been entirely deformed and the support element has virtually come to the ground by the support point, the entire construction forms a considerably stiffer whole and further energy will be absorbed in the support element itself and in the ground on which this element is supported.

In a particular embodiment, the support element is composed of a substantially upwardly directed first portion and, connected thereto, a second portion extending in the direction of the road, the guard member being attached to the second portion. Thus, the angle $\phi$ between the line between the pivot point and the collision point and the line between the pivot point and the support point can be chosen to be greater without the height of the guard rail construction increasing, while during a rearward tilting of the guard rail construction, a greater height increase can be realized. This construction further provides the possibility of designing the second portion so as to be displaceable in substantially rearward direction relative to the road, which allows this second portion to absorb a part of the collision energy. Of course, this would also have been possible if the second portion of the support element were of deformable design. In particular, it is favorable when the force at which the second portion can be displaced relative to the first portion is less than the force needed for compressing the deformable element under the support point. During slight collisions, the collision energy can then be entirely absorbed by said second portion, while during heavy collisions, a portion thereof is first absorbed in the second portion and the remaining part thereof is absorbed by the rearward movement of the entire support element and eventually by the substrate on which the support element is then supported.

In particular when the deformable element has a frustoconical shape whose portion having the greatest section lies directly below the support point on the support element, the forces acting thereon are readily absorbed through deformation. Although the deformable element could also have, for instance, a cylindrical shape, this shape is less desired; since a cylinder is more inclined to buckle.

In a concrete embodiment, the support element consists of two shell parts. The deformable element. may form an integral part of the support element or be attached thereto separately.

Because of the essential role performed by the pivot point, the collision point and the support point in the guard rail construction according to the invention, it is favorable when the support element or the first portion thereof has a substantially triangular shape.

Although the support element can be manufactured from steel, from a cost viewpoint it is favorable when the support element is formed from a fiber-reinforced plastic or composite. In particular, a construction from two shell parts can easily be realized by a compression molding process. As a matter of fact, the guard member can be designed in many manners; it can be formed by various types of girders, round, square, etc., or by prestressed cables. In particular, the presently employed guard rails can be used for this. The guard members can also be manufactured from a fiber-reinforced plastic.

BRIEF DESCRIPTION OF THE DRAWINGS

The invention will presently be further specified with reference to he accompanying drawing. In this drawing:

FIG. 5 shows the complete support element of FIG. 4, while

DETAILED DESCRIPTION OF THE INVENTION

Figure 1:
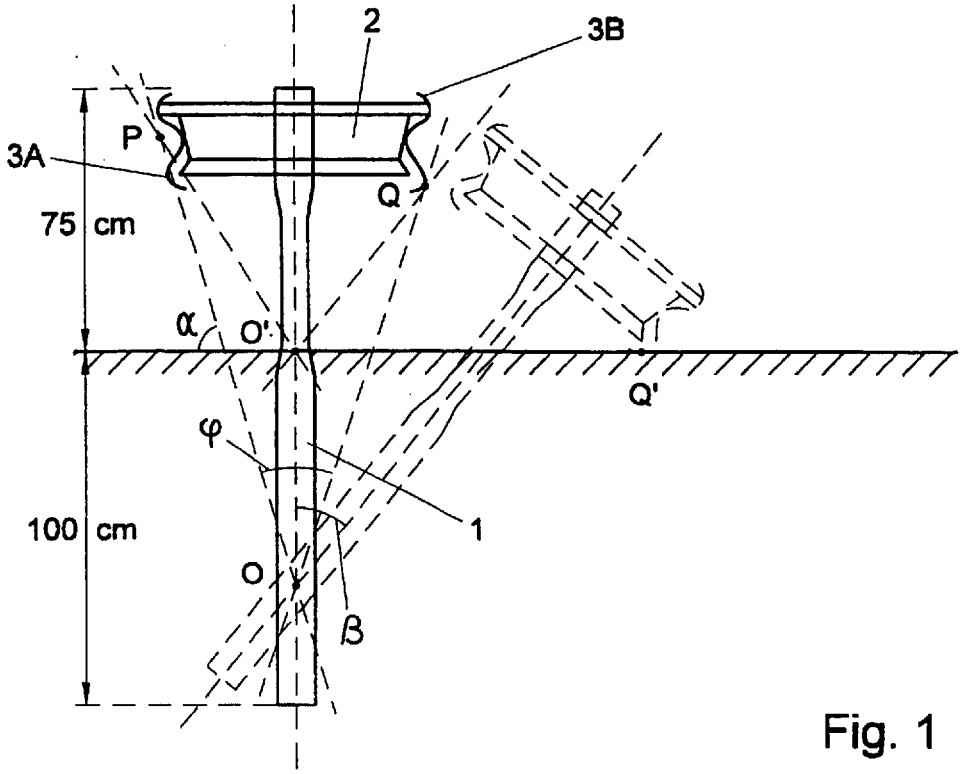
Fig. 1 PRIOR ART
FIG. 1 shows a known guard rail construction.

FIG. 1 shows a guard rail construction as presently employed along a number of Dutch roads. The support element 1 is provided in the ground over a depth of about 100 cm. The portion above the ground is about 75 cm. Provided adjacent the top end of the support element 1 is a transverse support 2 which projects over the same distance on either side of the support element 1. Mounted at the ends of a number of such support elements with transverse supports are guard rails 3A, 3B having a corrugated profile. When a vehicle collides against the guard rail 3A, not only this guard rail will be deformed, but also a number of support elements 1 will be pushed rearwards through the ground, with the ground absorbing a substantial part of the collision energy, until the guard rail 3B hits the ground, the ground absorbing the further collision energy. The support element 1 is supposed to move about the pivot point O, about 60 cm below the ground level. Although the vehicle contacts the guard rail over the entire height of the guard rail, the center thereof is considered to be the collision point P. The point whereby the guard rail construction is eventually supported on the ground is referred to as support point Q. In the tilted condition, shown in a broken line, this point is designated by Q'. When such guard rail construction is installed on, for instance, a bridge, the support construction is connected to an anchoring in the road surface via a break coupling. The pivot point is then designated by the point O'. In the first case, the angle $\alpha$ made by the fine OP with the ground level is about 72°, in the second case, this line, now designated by O'P, makes an angle of about 56°. In the first case, the guard rail construction can pivot through an angle $\beta$ of about 40° before the guard rail construction touches the ground by the guard rail, in the second case, this angle will be about 52°. In the first case, the angle $\phi$ between the lines OP and OQ is about 40°, in the second case, the angle between the corresponding lines O'P and O'Q is about 76°. Upon a rearward pivoting movement of the guard rail construction, only a slight upward movement of the guard rail 3A, takes place. Accordingly, both situations involve a considerable risk that a vehicle colliding against the guard rail construction tilts over the guard rail 3A, in particular when the point of gravity of the vehicle projects substantially above the guard rail 3A. This risk is even considerably greater in the second case, where the guard rail construction is, for instance, installed on a bridge, where the pivoting angle β is much greater and the colliding vehicle may also contact the support element.

Figure 2:
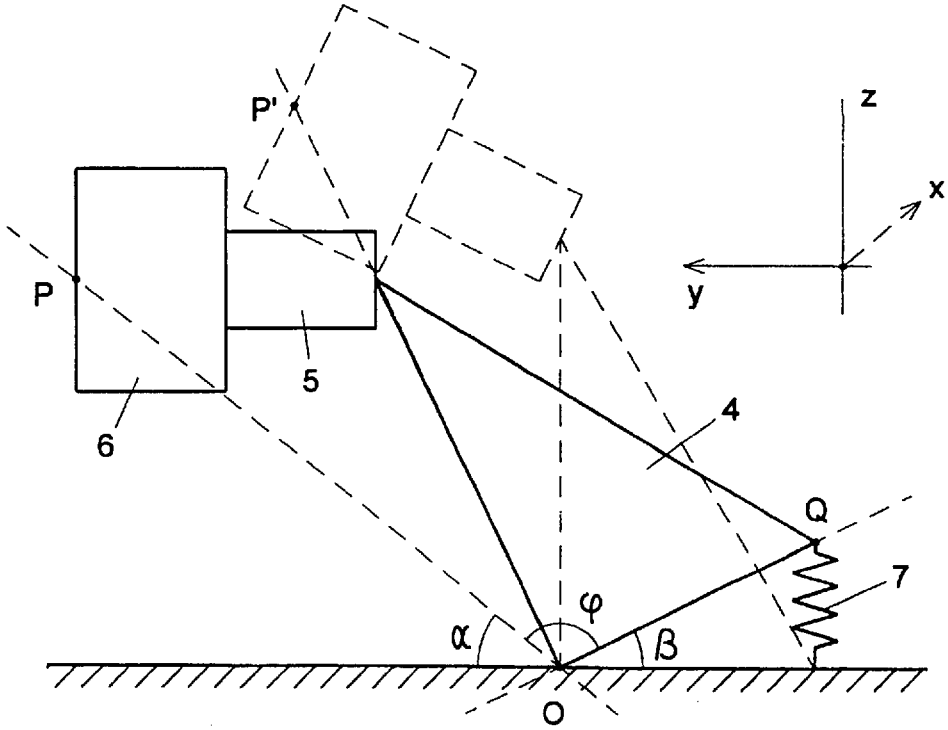
FIG. 2 shows the principle according to which the guard rail construction according to the invention is built up.

FIG. 2 shows the principle of a guard rail construction according to the invention. Here, the support element 1 consists of a substantially upwardly directed first portion 4 and, connected. therewith, a second portion 5 extending in the direction of the road, the guard member 6 being attached to the second portion 5. The bottom side of the guard member 6 is located at a higher position than the support point Q. Here, the angle ϕ is in the order of 130°; however, this angle should at any rate be greater than 90°. It is understood that during a rearward movement of the guard rail construction until the point Q has reached the ground, which situation is indicated in broken lines and here occurs upon a pivoting movement of the support element 4 through an angle β smaller than 45°, and in FIG. 2 through about 30°, a considerable increase in height occurs, viz. in the order of about 25%, through which upward movement of the guard member 6 during the collision, a couple is exerted on the vehicle which opposes the couple that causes the vehicle to tilt. FIG. 2 further shows a deformable element 7. This element is provided on the support element 4, between the support point Q and the substrate on which the guard rail construction is supported. Thus, the collision energy is first absorbed by the rearward movement of the guard rail construction and by the tilting-preventing couple exerted on the vehicle by the guard rail construction, subsequently by the deformation of the element 7 and, finally, by the substrate itself.

The principal construction for a guard rail construction shown in FIG. 2 proves to have the further advantage of occupying a narrower strip of ground than the known guard rail construction described with reference to FIG. 1.

The dimensioning of the guard rail construction shown in FIG. 2 has been attuned to the European design standard prEN 1317. In this standard, the different load levels for guard rail constructions are laid down, as well as the manner in which it is to be assessed whether a particular guard rail construction meets such load level. At a chosen load at a relatively high level (H2), the guard rail system should satisfy the tests TB51+TB11. Test TB51 concerns a collision test with a vehicle of 13000 kg (autobus) colliding against a guard rail at a speed of 70 km/h and at an angle of 20°. Test TB11 concerns a collision test with a vehicle of 900 kg (light passenger car) colliding against a guard rail at a speed of 100 km/h and at an angle of 20°. A dimensioning of the elements in FIG. 2 with the following parameters satisfies these tests in ample measure. The guard member 6 is 20 cm wide and 30 cm high; the distance from the top edge of the guard rail to the substrate is 60 cm; the second portion 5 is 20 cm long; the distance from point Q to the substrate is 15 cm; the distance from point O to the protection of point Q on the substrate is 30 cm and the distance from the projection of he connecting point of the first to the second portion of the support element to the point O is 25 cm. The rigidity of the support element or the first portion 4 thereof is of little importance as long as this element or first portion does not break during tilting rearwards, it being observer that a few support elements or first portions thereof are allowed to break at the moment when they are supported on the ground. The second portion 5 should deform or move rearwards at an occurring force in the y-direction of 0–20 kN, preferably of 5–10 kN. The guard member 6 should preferably have a minimal bending stiffness about the z-axis of $10^5$ $Nm^2$. The deformable element 7 should deform at an occurring force in the z-direction of 30–100 kN, preferably of 50–80 kN.

Figure 3:
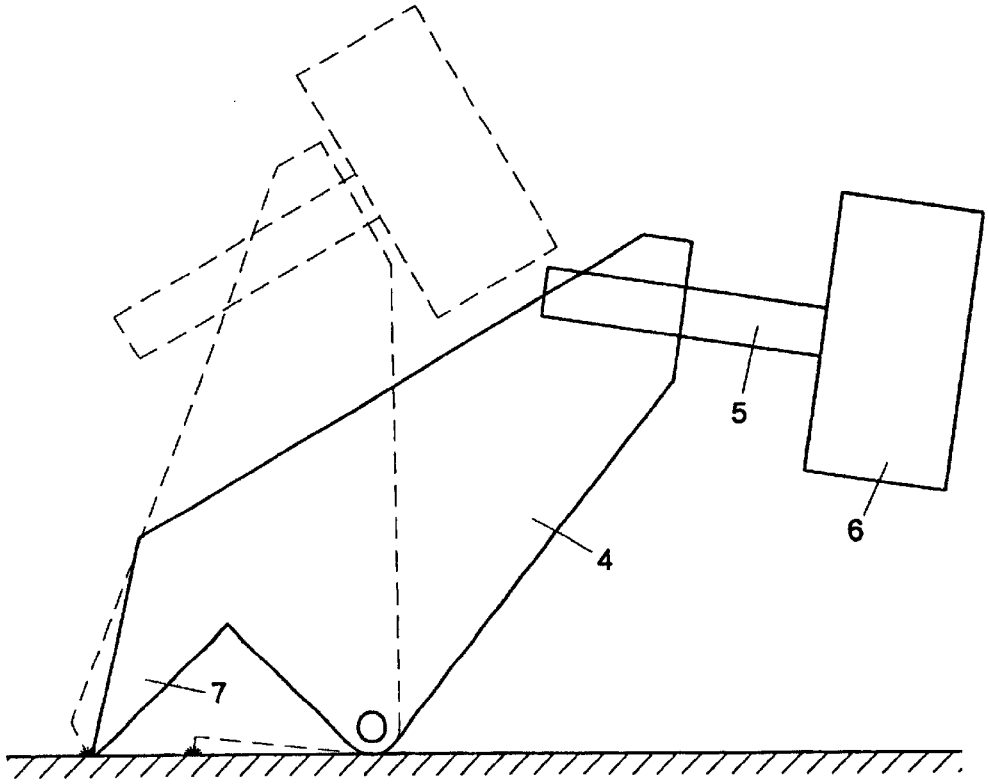
FIG. 3 shows, in a schematic manner, the condition of the guard rail construction according to the invention before and after a collision of a vehicle thereagainst.

FIG. 3 shows, in a schematic manner, a guard rail construction according to the invention, in which a part of the collision energy is also absorbed by the second portion 5 of the support element 1 which, against a particular resistance relative to the first portion 4, moves rearwards during a collision. The force at which the second portion 5 is displaced relative to the first portion 4 is less than the force required for compressing the plastic deformable element 7, so that during a slight collision, the guard member 6 moves rearwards first and the plastic element 7 is deformed only after that. For that purpose, the first portion has a throughbore through which the second portion 5 can move after having overcome a particular resistance. Various constructions are conceivable for this. It is also possible to arrange that the bore in the first portion does not continue entirely or to provide a stop therein and to provide a plastic deformable element in the bore, against which the second portion 5 jams during a rearward movement. The second portion 5 may also be entirely formed by a plastic deformable element. In FIG. 3, the position of the guard rail construction after the collision is shown in broken lines. In this last position, the deformable element 7, which in this embodiment forms one whole with the support element, is pulverized almost completely.

Figure 4:
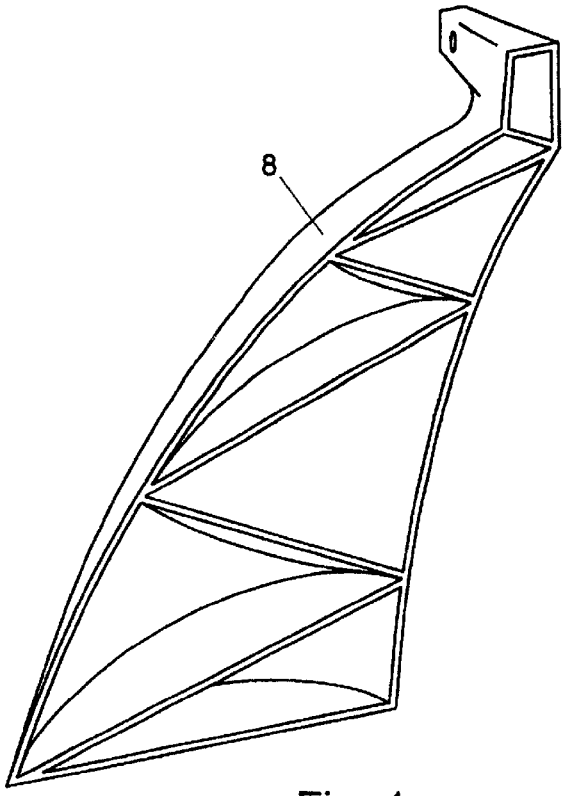
FIG. 4 shows one of the two shell parts from which the support element in a specific embodiment according to the invention is built up.
Figure 5:
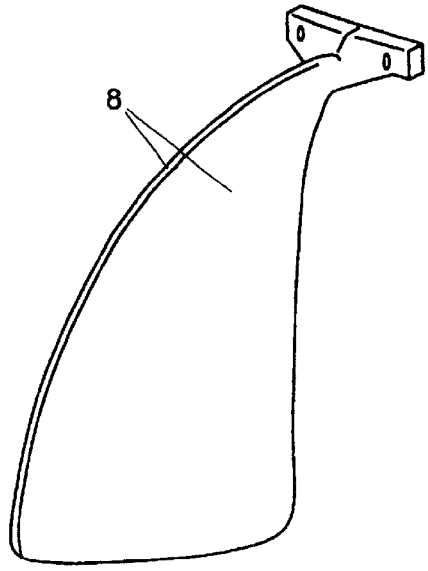

FIGS. 4 and 5 show a concrete embodiment of the support element, in which it is built up of two shell parts 8 which can readily be manufactured from fiber-reinforced plastic, with reinforcement ribs and partitions, which shell parts are subsequently attached to each other, while at the top end, the second portion 5 can be inserted herein, while at the bottom side, the deformable element in the form of a truncated cone can be provided.

The pivot point O is formed by a pivot provided on a solid substrate, This substrate may be formed by the road material or by a special concrete plate arranged at the aide of the road. This plate may extend rearwards so far that the deformable element 7 can also be supported thereby and can be pulverized against it during the rearward movement of the guard rail construction. The pivot mentioned can be designed in various manners, for instance by a shaft passed through the two shell parts and bearing-mounted at both ends on said solid substrate. The support element can also be connected to said substrate by means of a deformable, fixed element, to form a pivot point.

Figure 6:
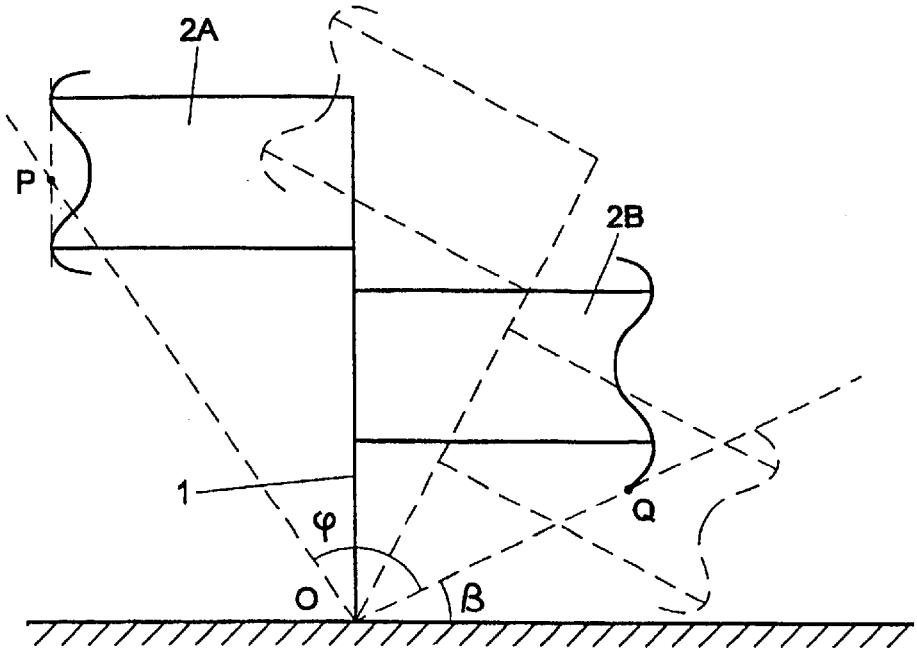
FIGS. 6 and 7 show two alternative exemplary embodiments.
Figure 7:
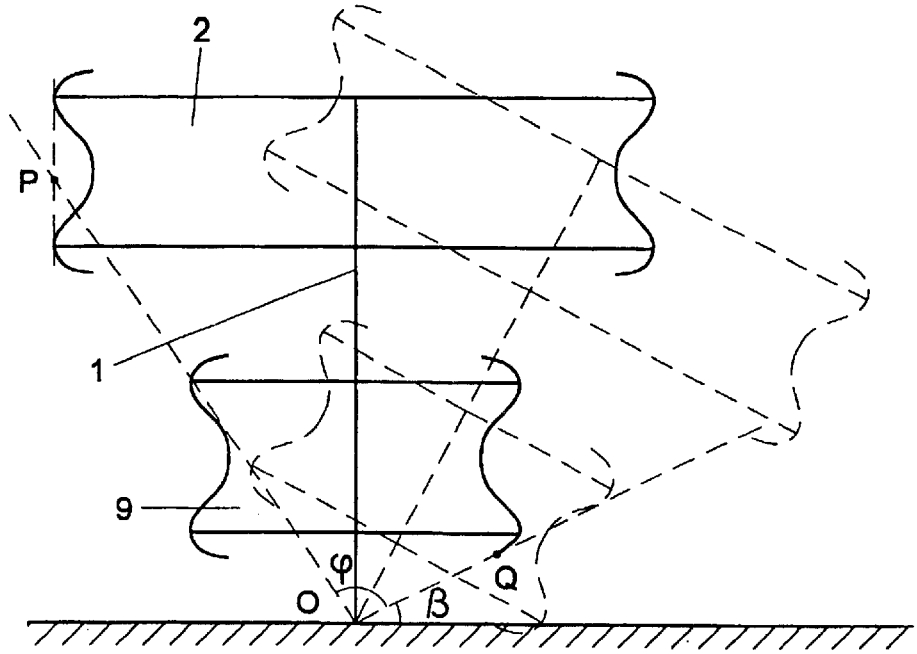

FIGS. 6 and 7 show two alternatives for a guard rail construction according to the invention. In both alternatives, use is made of a guard member corresponding to the known guard rails. In FIG. 6, the transverse support 2 consists of two parts 2A and 2D arranged at different heights on either side of the support element 1, in such a manner that the angle ϕ is about 95° and the angle β is about 25°. In FIG. 7, the construction of FIG. 1 is extended by a second transverse element 9 which is provided under the transverse element 2 and is shorter, such chat the angle ϕ is about 100° and the angle β is about 20°.

The invention is not limited to the embodiments represented herein, but embodies various modifications hereof, of course in so far as they fall under the protective scope of the following claims. In particular, it is pointed out that various known guard members, girders, corrugated, sheets and prestressed cables are possible. The choice of material, in particular of the support element, is not limited to fiber-reinforced plastics, all kinds of suitable metals can be used.

The shape, too, can be chosen at random, as long as it is not such that a colliding vehicle can be expected to contact the support element. The support element need not be composed of two parts; the above-mentioned second portion 5 could be omitted. At the most, the shape of the first portion will have to be slightly adjusted. By choosing, for instance, a deformable element as pivot for the support element with the substrate, the deformable element 7 may be left out under conditions. The shape of the deformable element 7 may be chosen at random as well.

What is claimed is:

1. A guard rail construction for use at an outer edge of a road, the guard rail construction comprising:

a guard member, the guard member defining a collision point;

a support element attached to the guard member, the support element being supportable on a substrate such that the support element is pivotable in a rearward direction relative to the outer edge of the road from an upright position about a pivot point to such an extent that the support element is supported on the substrate at a support point, wherein the support point is arranged in a higher position relative to the substrate than the pivot point when the support element is in the upright position and an angle between a line through the pivot point and the collision point and a line through the pivot point and the support point is greater than 90°, the pivot point being formed through the deformation of a weakening in the support element; and a deformable element provided on the support element for at least partially absorbing collision energy, the deformable element being disposed behind or in a vertical plane which extends through the pivot point perpendicular to the substrate.

2. The guard rail construction according to claim 1, wherein the guard member is arranged only on a road-facing side of the support element.

3. The guard rail construction according to claim 1, wherein an angle through which the support element can pivot before the support point comes engages the substrate is less than 45°.

4. The guard rail construction according to claim 1, wherein the support point is located at a lower position relative to the substrate than a bottom side of the guard member.

5. The guard rail construction according to claim 1, wherein the deformable element is arranged on the support element between the support point and the substrate on which the support element can be supported.

6. The guard rail construction according to claim 1, the support element further comprising:

a substantially upwardly directed first portion; and a second portion connected to the first portion, wherein the second portion extends in the direction of the outer edge of the road, and the guard member is attached to the second portion.

7. The guard rail construction according to claim 6, wherein the second portion is displaceable in a substantially rearward direction relative to the outer edge of the road.

8. The guard rail construction according to claim 7, wherein a force at which the second portion can be displaced relative to the first portion is less than a force required for the deformation of the weakening in the pivot point and the deformable element.

9. The guard rail construction according to claim 1, wherein the deformable element forms an integral part of the support element.

10. The guard rail construction according to claim 6, wherein the first portion has a substantially triangular shape.

11. The guard rail construction according to claim 1, wherein the deformable element has a frustoconical shape having a portion of greatest cross-sectional area directly below the support point on the support element.

12. The guard rail construction according to claim 6, wherein the first portion of the support element consists of two shell parts.

13. The guard rail construction according to claim 1, wherein the support element has a substantially triangular shape.

14. The guard rail construction according to claim 1, wherein the support element is formed from a fiber-reinforced plastic or composite material.

* * * * *

UNITED STATES PATENT AND TRADEMARK OFFICE

CERTIFICATE OF CORRECTION

PATENT NO. : 6,551,012 B1
DATED : April 22, 2003
INVENTOR(S) : Hoebergen et al.

It is certified that error appears in the above-identified patent and that said Letters Patent is hereby corrected as shown below:

Title page,
Item [73] Assignees, "Nederladnse Organisatie voor Toegepast-Natuurwetenschappelijk on-Derzoek Tno" should read as -- Nederlandse Organisatie voor toegepast-natuurwetenschappelijk Onderzoek TNO --.

Signed and Sealed this

Twenty-third Day of September, 2003

JAMES E. ROGAN
*Director of the United States Patent and Trademark Office*